US012232563B1

(12) United States Patent
Nguyen

(10) Patent No.: US 12,232,563 B1
(45) Date of Patent: Feb. 25, 2025

(54) ADJUSTABLE HIGH HEEL

(71) Applicant: Nghi Nguyen, Las Vegas, NV (US)

(72) Inventor: Nghi Nguyen, Las Vegas, NV (US)

( * ) Notice: Subject to any disclaimer, the term of this patent is extended or adjusted under 35 U.S.C. 154(b) by 0 days.

(21) Appl. No.: 18/366,754

(22) Filed: Aug. 8, 2023

(51) Int. Cl.
*A43B 21/39* (2006.01)
*A43B 3/24* (2006.01)
*A43B 3/26* (2006.01)

(52) U.S. Cl.
CPC ..... *A43B 21/39* (2013.01); *A43B 3/246* (2013.01); *A43B 3/26* (2013.01)

(58) Field of Classification Search
CPC .. A43B 3/24; A43B 3/246; A43B 3/26; A43B 13/36; A43B 21/39; A43B 21/40
See application file for complete search history.

(56) References Cited

U.S. PATENT DOCUMENTS 3,464,126 A * 9/1969 Sarkissian ..... A43B 21/30 36/34 R
4,146,981 A * 4/1979 Renaldo ..... A43B 3/24 36/15
5,309,651 A * 5/1994 Handel ..... A43B 21/433 36/97
7,877,902 B2 * 2/2011 Pieriboni ..... A43B 3/24 36/34 R
8,112,906 B2 * 2/2012 Paik ..... A43B 21/39 36/100
8,322,053 B2 * 12/2012 Handel ..... A43B 21/433 36/100
9,289,025 B2 * 3/2016 Damodar ..... A43B 21/36
9,332,806 B2 * 5/2016 Guardado ..... A43B 21/52
9,936,761 B2 * 4/2018 Alan ..... A43B 3/24
9,980,533 B2 * 5/2018 Huber ..... A43B 21/42
10,045,591 B2 * 8/2018 Isinhue ..... A43B 21/433
10,966,486 B2 * 4/2021 Berberian ..... A43B 3/246
12,042,010 B2 * 7/2024 Fusaro ..... A43B 21/433
2010/0083537 A1 * 4/2010 Wierda ..... A43B 13/16 36/100
2010/0139123 A1 * 6/2010 Alan ..... A43B 21/46 36/103
2013/0160332 A1 * 6/2013 Yoon ..... A43B 21/26 36/36 R
2014/0298685 A1 * 10/2014 Alan ..... A43B 21/48 12/147 R
2016/0073725 A1 * 3/2016 Guenoun ..... A43B 13/36 36/100

* cited by examiner

*Primary Examiner* — F Griffin Hall
(74) *Attorney, Agent, or Firm* — QuickPatents; Kevin Prince

(57) ABSTRACT

An adjustable height shoe can include a shoe shank member extending between a heel end to a toe end of the shoe. A heel member can be removably attachable, at an attachment end thereof, to the shoe shank member. The attachment end of the heel member is insertable into the shoe shank member in a first direction to create a first shoe configuration and the attachment end of the heel member is insertable into the shoe shank member in a second direction to create a second shoe configuration. The shoe can further include a shoe shank member hole and one or more heel member holes that can align with each other when the attachment end of the heel member is inserted into the shoe shank member. A connector can fit into the aligned holes to maintain a connection between the shoe shank member and the heel member.

20 Claims, 9 Drawing Sheets

ADJUSTABLE HIGH HEEL

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to footwear, and more particularly to a high heel shoe where the user can adjust the heel height.

BACKGROUND

Wearing high heels for an extended amount of time can cause irreversible damage to your joints and muscles. In addition, continually bending your toes into an unnatural position may lead to ingrown toenails, damage to leg tendons and nerves, bunions, and more. In some situations, a user may desire to wear a high heel shoe for part of the event or part of a day, while a lower heel shoe would be acceptable and more comfortable for the remainder of the event or day.

Referring to FIG. 13, a conventional high heel shoe can include an outsole 108 attached, at a heel end thereof, to a neck 110 of a heel 109. A heel tip 111 can provide a surface contact point for the heel 109. A metal shank 106 can extend along a top of the heel 109 and the outsole 108. A bottom filling 107 may be positioned at the toe end on top of the outsole 108. An inner sole 105 can be placed over the bottom filling 107 and the metal shank 106, along the entire length of the top of the shoe. A sock 104 can then be placed on top of the inner sole 105 and a toe puff 101, upper 102 and stiffener 103 can form the uprising and top surfaces of the shoe. Such conventional high heel shoes are not adjustable in height by a user.

Therefore, there is a need for a shoe that can provide a fashionable high heel that can have a heel height that can be adjustable by the user. The present invention accomplishes these objectives.

SUMMARY OF THE INVENTION

The present device is an adjustable height shoe, such as a high heel shoe, where the user can change an angle of the shoe (such as the outsole or insole of the shoe) to provide differing height heels.

The adjustable height shoe can include a shoe shank member extending between a heel end to a toe end of the shoe. A heel member can be removably attachable, at an attachment end thereof, to the shoe shank member. The attachment end of the heel member is insertable into the shoe shank member in a first direction to create a first shoe configuration and the attachment end of the heel member is insertable into the shoe shank member in a second direction to create a second shoe configuration. In some embodiments, the amount of insertion of the attachment end of the heel member into the shoe shank member can provide additional height adjustment capability within either the first shoe configuration and/or the second shoe configuration.

In some embodiments, first and second opposing shoulders are disposed along sides of a portion of a bottom of the shoe shank member. The opposing shoulders can be operable to receive the attachment end of the heel member therein. The opposing shoulders can include an upper surface mating with a lower surface of the attachment end of the heel member. In some embodiments, the opposing shoulders are located centrally along a length of the bottom of the shoe shank member. In some embodiments, an insertion stop can be disposed adjacent the attachment end. The insertion stop can provide a maximum insertion of the attachment end into the shoe shank member.

In some embodiments, the shoe further includes a shoe shank member hole, formed through the shoe shank member, and one or more heel member holes, formed through the heel member. The shoe shank member hole can align with one of the one or more heel member holes when the attachment end of the heel member is inserted into the shoe shank member. In some embodiments, a connector can fit into the shoe shank member hole and one or the one or more heel member holes to maintain a connection between the shoe shank member and the heel member.

Embodiments of the present invention thus provides for an adjustable height shoe where the user can easily adjust the heel height without needing any additional tools and without requiring the user to carry any different parts (such as carrying other heel length. In other words, the user can, by using the parts they are wearing on their feet, change the height of the heel of the shoe. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
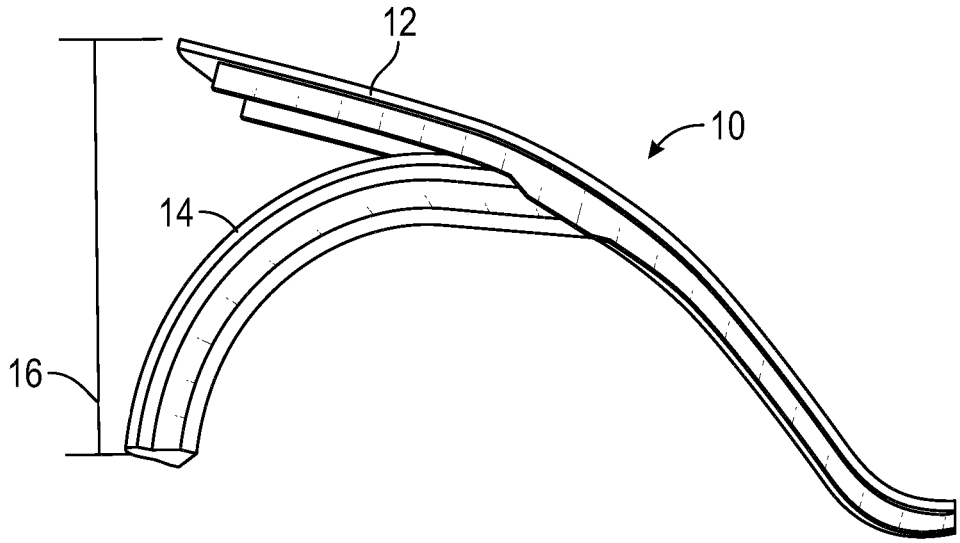
FIG. 1 is a side view of a shoe construction in a lower heel configuration, according to an exemplary embodiment of the present invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Referring now to FIGS. 1 through 12, a shoe 10, 20 can include a shoe shank member 12 extending between a heel end 34 to a toe end 30 of the shoe. A heel member 14, which includes an attachment end 24 and a base end 42 opposite the attachment end 24 (see FIGS. 1, 2 and 8), can be removably attachable, at [an] the attachment end 24 thereof, to the shoe shank member 12. A connector 50, as described in greater detail below, can help fix the heel member 14 with the shoe shank member 12 in a desired position. The adjustability of the shoe 10, 20 is performed with these three members—the shoe shank member 12, the heel member 14 and the connector 50. Further, these three members are in use when the shoe is adjusted into any of the two or more heel heights. Thus, to adjust to a different heel height, the shoe 10, 20 uses the parts of the shoe at the original height. In other words, there are no additional parts to carry or replace. Instead, the parts are rearranged to provide the varying shoe heights.

Figure 2:
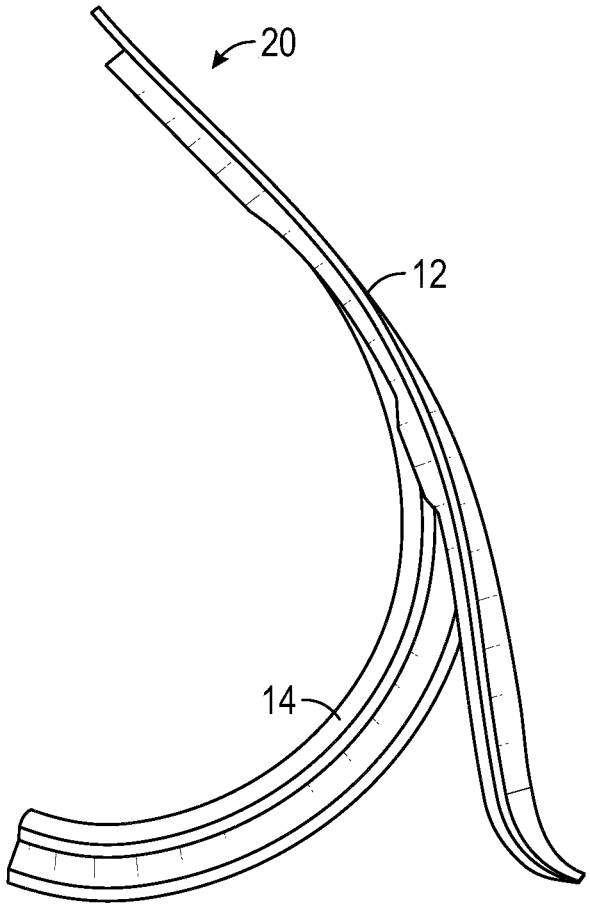
FIG. 2 is a side view of a shoe construction in a higher heel configuration, according to an exemplary embodiment of the present invention.
Figure 3:
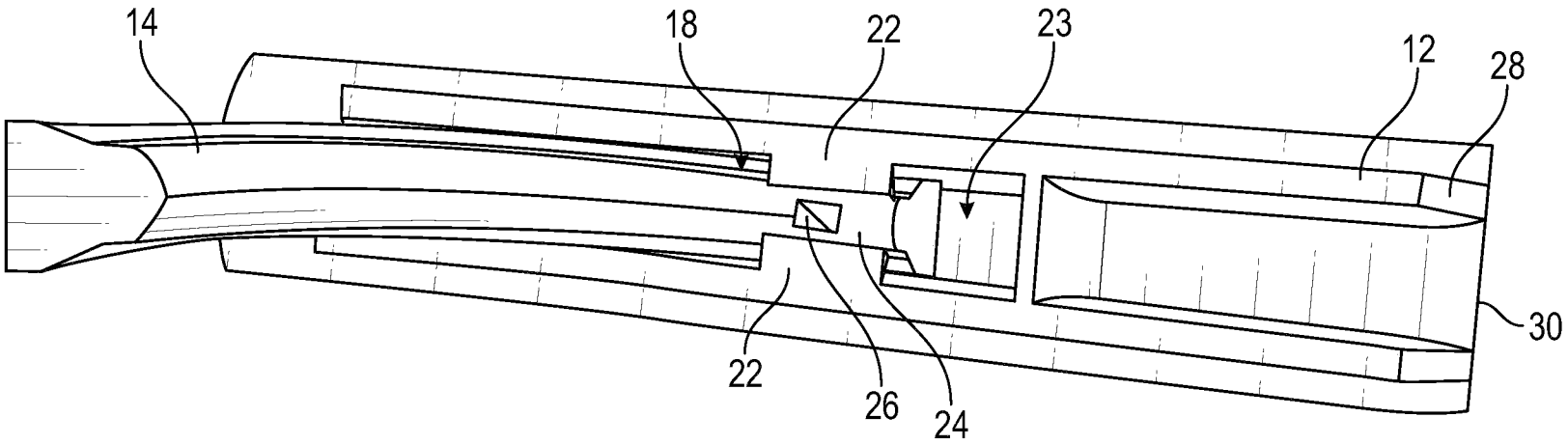
FIG. 3 is a bottom view of the shoe construction of FIG. 1.
Figure 4:
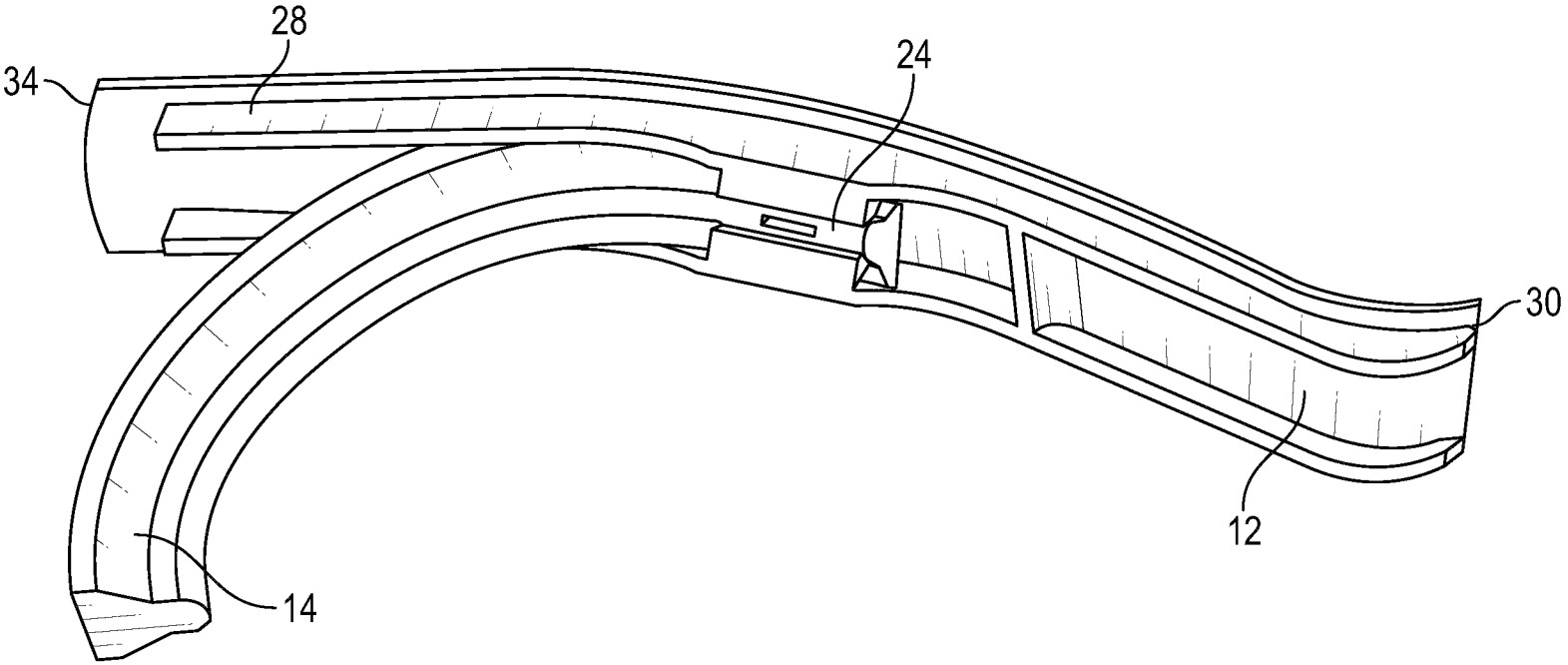
FIG. 4 is a bottom perspective view of the shoe construction of FIG. 1.
Figure 5:
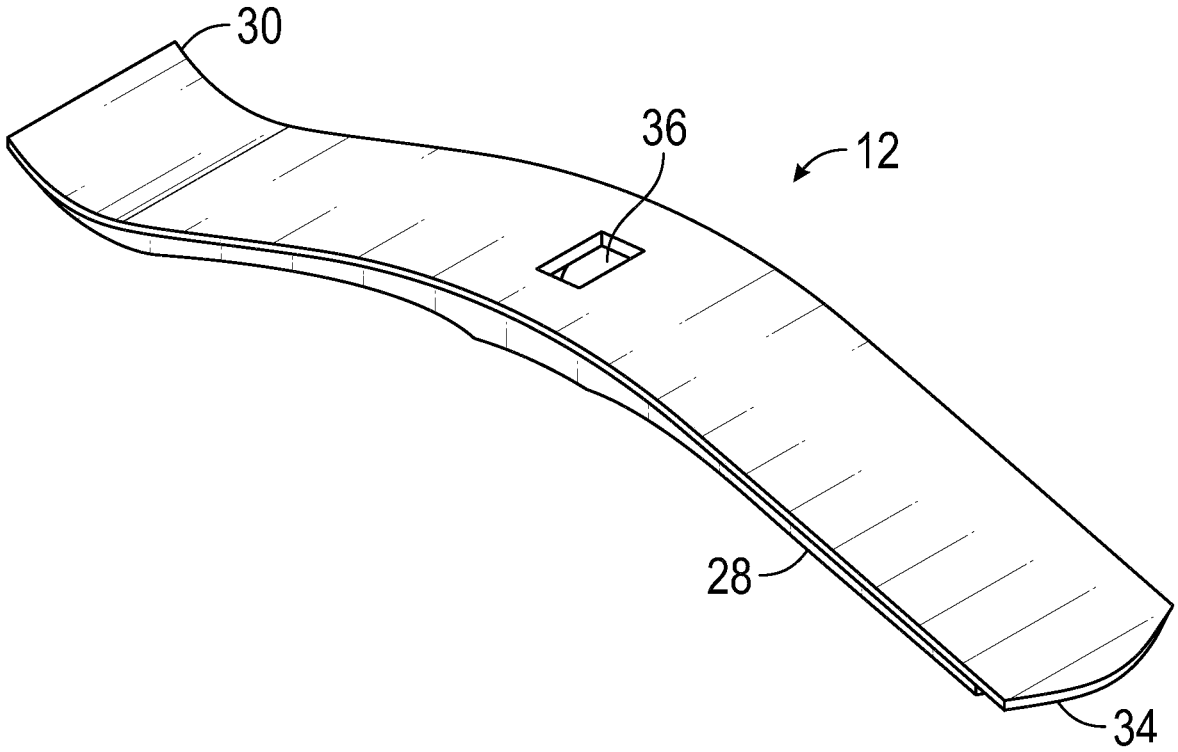
FIG. 5 is a top perspective view of the shoe shank member of the shoe construction of FIGS. 1 and 2.
Figure 6:
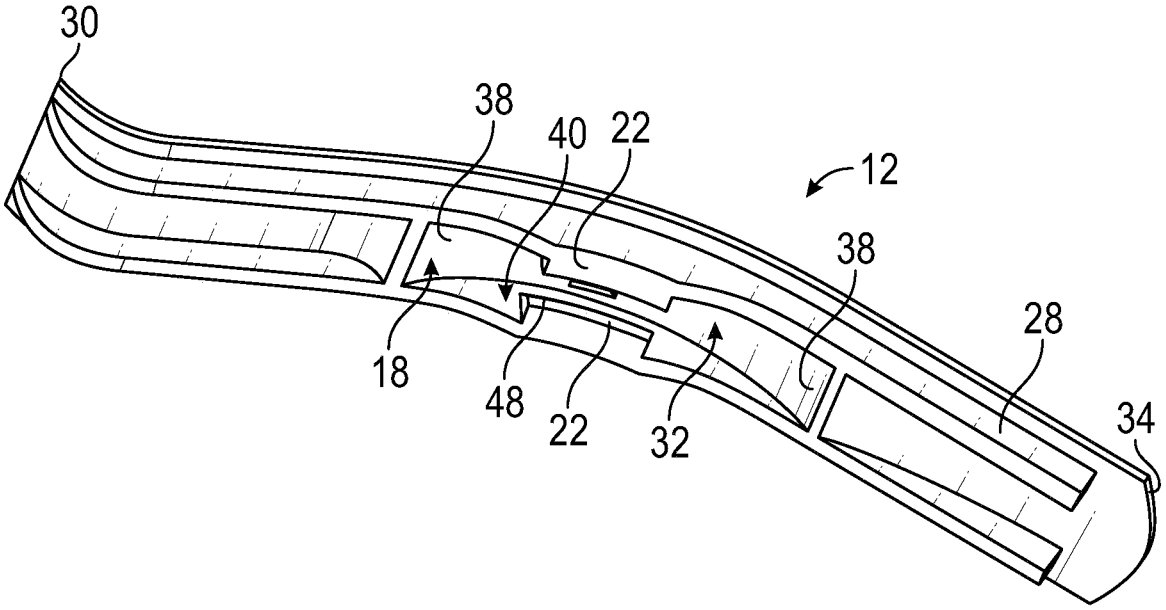
FIG. 6 is a bottom perspective view of the shoe shank member of the shoe construction of FIGS. 1 and 2.
Figure 7:
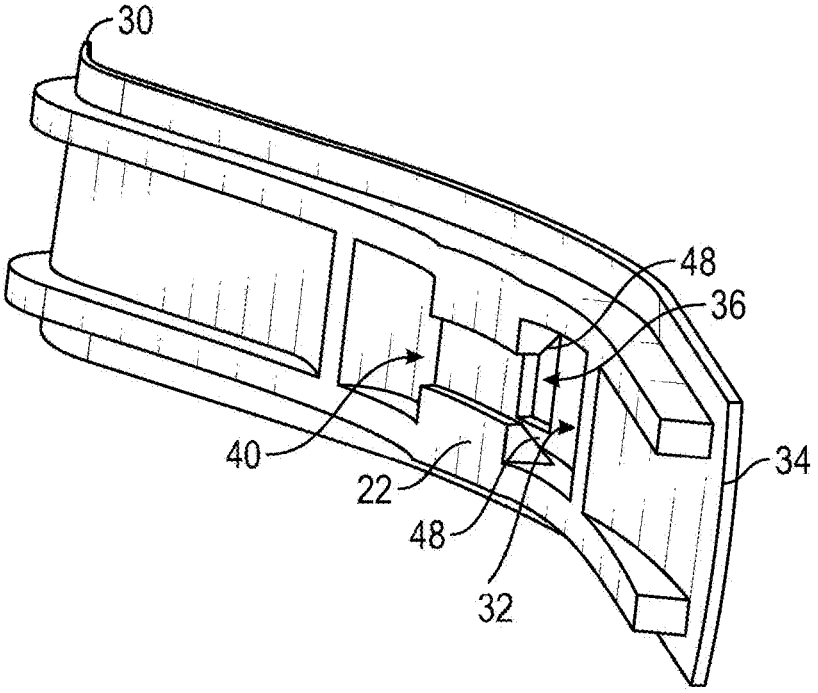
FIG. 7 is a bottom, top-side perspective view of the shoe shank member of the shoe construction of FIGS. 1 and 2.
Figure 8:
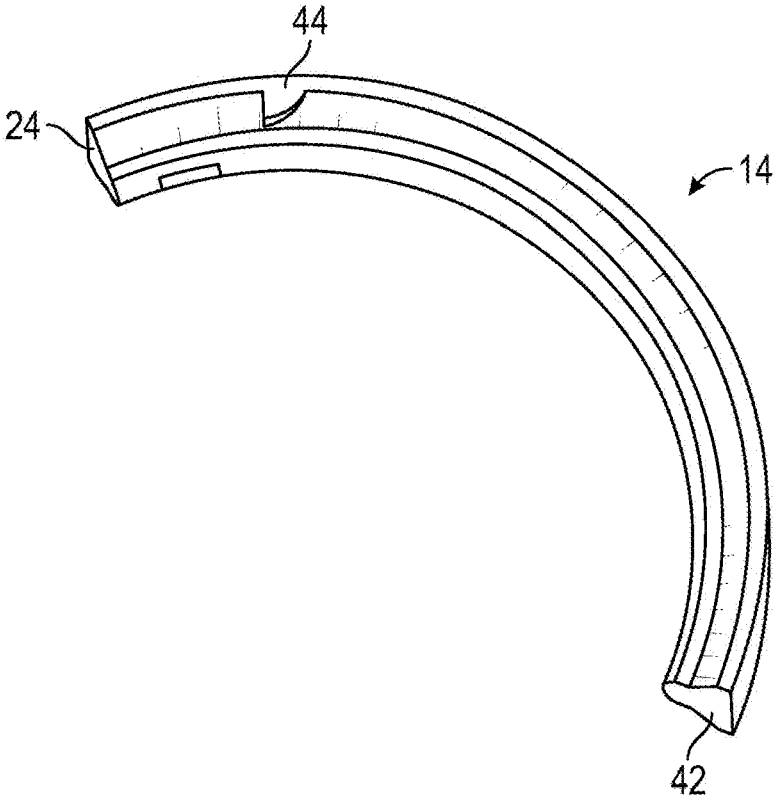
FIG. 8 is a side view of the heel member of the shoe construction of FIGS. 1 and 2.
Figure 9:
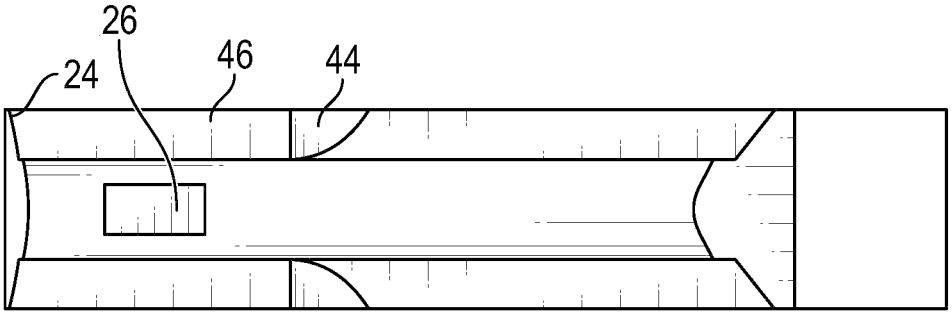
FIG. 9 is a bottom view of the heel member of the shoe construction of FIGS. 1 and 2.
Figure 10:
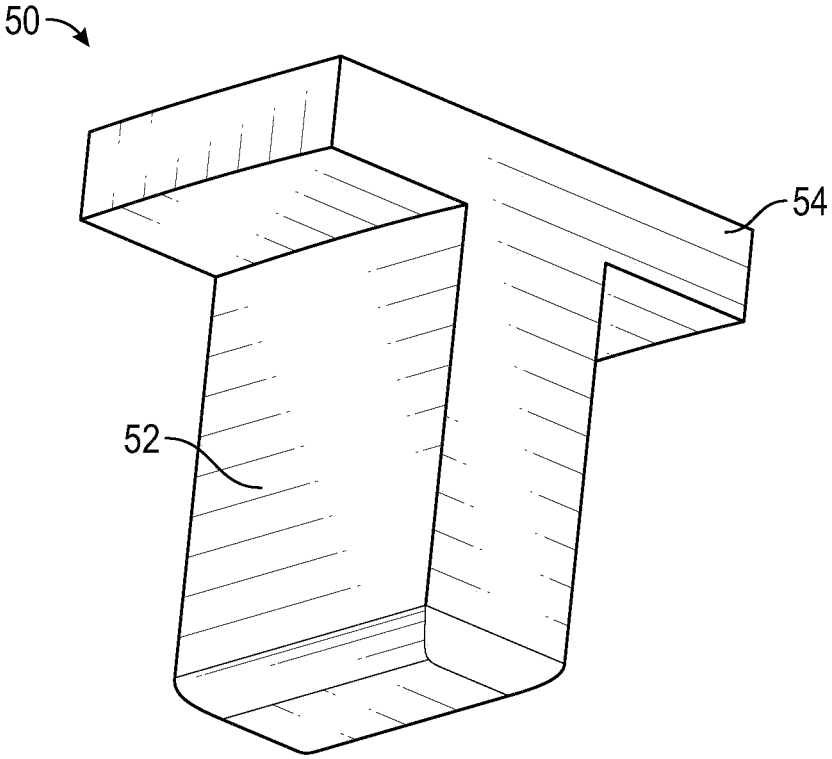
FIG. 10 is a perspective view of a connector usable to fix the position of the heel member with the shoe shank member, according to an exemplary embodiment of the present invention.

The attachment end 24 of the heel member 14 is insertable into the shoe shank member 12 in a first direction from a first side 32 to create a first shoe configuration, as shown in FIG. 1. The attachment end 24 of the heel member 14 is insertable into the shoe shank member 12 in a second direction from a second side 40 to create a second shoe configuration, as shown in FIG. 2. The first shoe configuration may have a lower heel height 16 (see FIG. 1), where the heel height 16 is measured from the top of the shoe shank member 12, where the user's heel would rest when worn, to the base of the heel member 14.

In some embodiments, the heel member 14 includes two or more attachment locations along the attachment end 24 thereof, providing two or more heel heights in at least one of the first shoe configuration and the second shoe configuration. For example, a shoe shank member hole 36 can be formed through the shoe shank member 12 and one or more heel member holes 26 can be formed through the heel member 14. The shoe shank member hole 36 can align with one of the one or more heel member holes 26 when the attachment end 24 of the heel member 14 is inserted into the shoe shank member 12. The connector 50 can fit into the shoe shank member hole 36 and one of the one or more heel member holes 26 to maintain a connection between the shoe shank member 12 and the heel member 14. In some embodiments, the connector 50 includes an enlarged head 54 with a shaft 52 that extends therefrom, the shaft 52 being operable to extend through both the shoe shank member hole 36 and one of the one or more heel member holes 26. The enlarged head 54 can prevent the connector 50 from falling out as the connector is inserted from above the shoe shank member 12. In some embodiments, the enlarged head may be larger than the size of the shoe shank member hole 36. In some embodiments, the shoe shank member hole 36 can include an outer recessed portion (not shown) so that the enlarged head 54 can fit into the outer recessed portion without passing entirely through the shoe shank member hole 36. In this embodiment, the top surface of the enlarged head 54 may be flush or nearly flush with the top surface of the shoe shank member 12.

In some embodiments, rails 28 may extend on opposing sides from a bottom side 23 of the shoe shank member 12. In some embodiments, first and second opposing shoulders 22 can be disposed along sides of a portion of the bottom side 23 of the shoe shank member 12. In some embodiments, the opposing shoulders 22 extend inward from each of the rails 28 along a portion thereof. The opposing shoulders 22 can be operable to receive the attachment end 24 of the heel member 14 therein. The opposing shoulders 22 can include an upper surface 48 mating with a lower surface 46 of the attachment end 24 of the heel member 14. In some embodiments, a sloped ramp 38 may be provided on the bottom side 23 of the shoe shank member 12, where the sloped ramp 38 can extend forward and rearward of the opposing shoulders 22 in a longitudinal direction of the shoe shank member 12. In some embodiments, the opposing shoulders 22 can be located centrally along a length of the bottom of the shoe shank member 12. Once assembled, for example, in the higher heel configuration of FIG. 2, the top side of the heel member 14 can press against a portion 18 of the sloped ramp 38 to provide additional support between the shoe shank member 12 and the heel member 14.

In some embodiments, an insertion stop 44 can be disposed adjacent the attachment end 24. The insertion stop 44 can provide a maximum insertion of the attachment end 24 into the shoe shank member 12.

Figure 11:
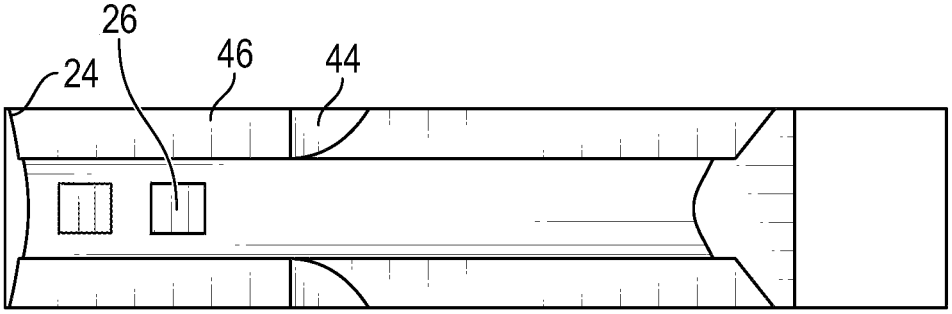
FIG. 11 is a bottom view of a heel member having multiple adjustable positioning holes, according to an exemplary embodiment of the present invention.
Figure 12:
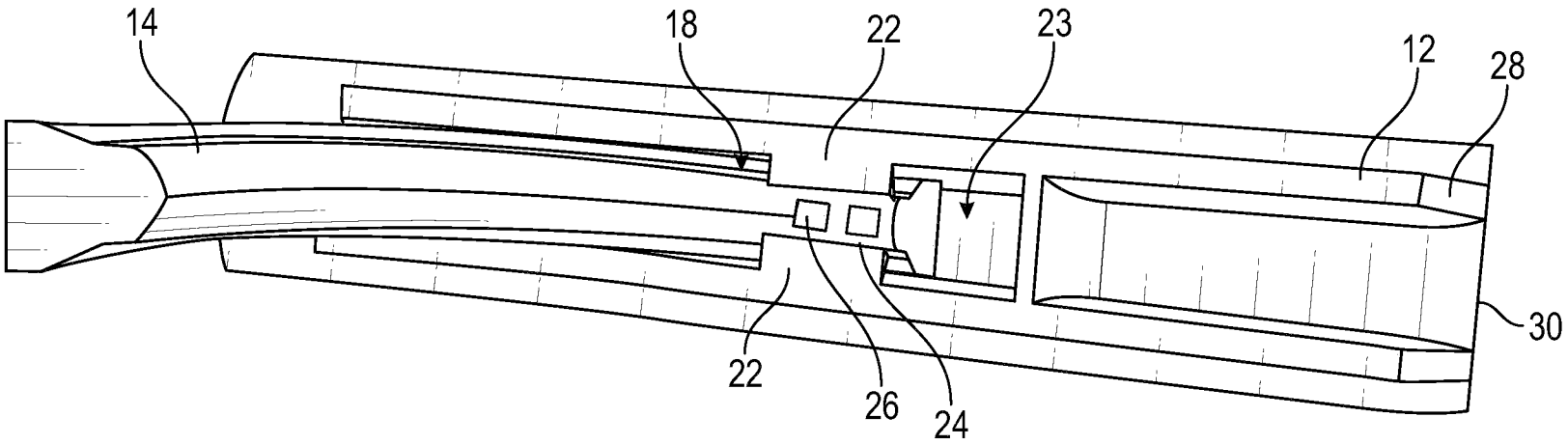
FIG. 12 is a bottom view of the shoe construction of FIG. 1 using the heel member of FIGS. 10.
Figure 13:
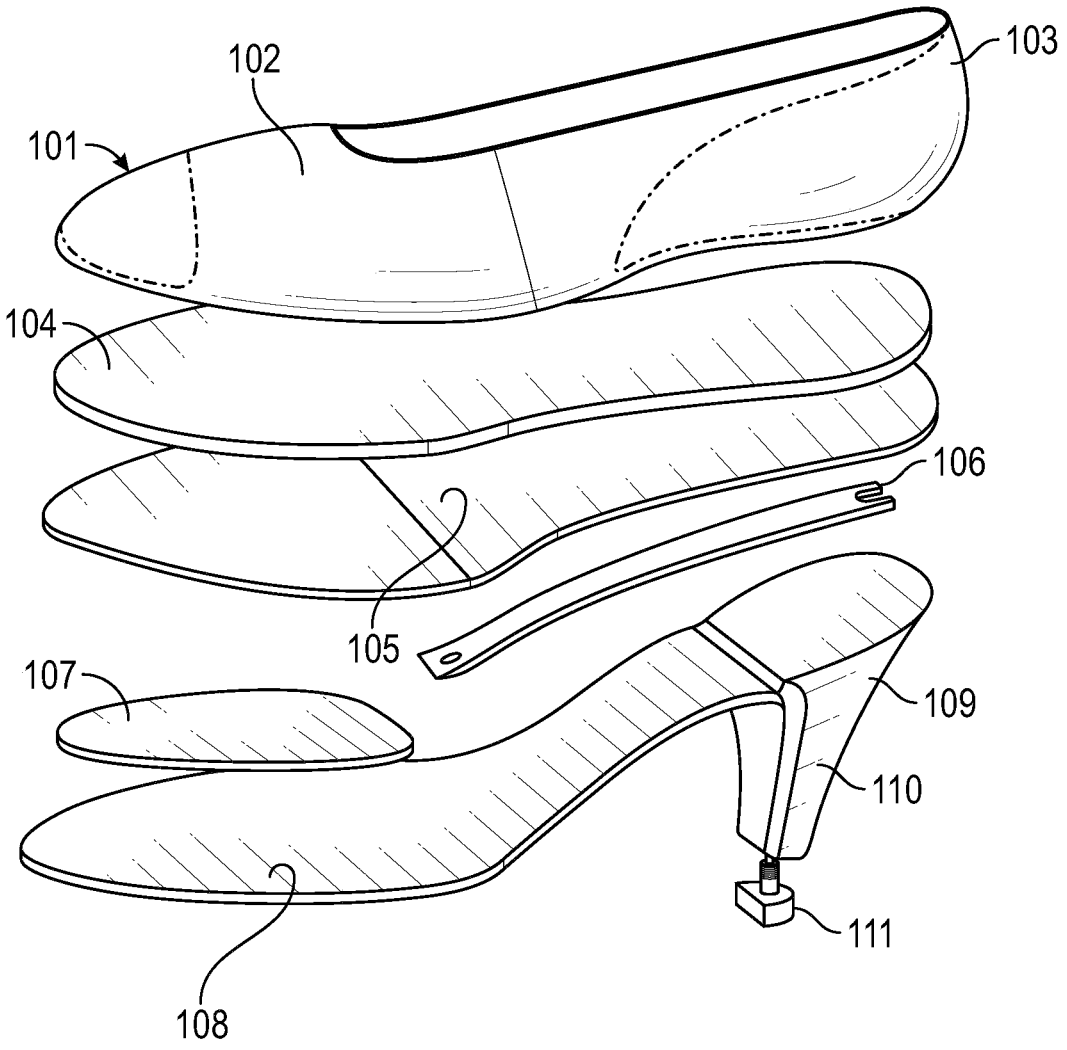
FIG. 13 (Prior Art)
FIG. 13 is an exploded perspective view of a conventional shoe.

As shown in FIGS. 11 and 12, the heel member 14 can include multiple heel member holes 26, where, by using an inner one of the heel member holes 26, the heel height of the shoe may be further decreased. Thus, a single shoe may provide two, three, or more height adjustment positions. While two heel member holes 26 are illustrated, additional heel member holes may be provided, such as three or four holes, for example, equally spaced along the attachment end 24 of the heel member 14.

While a particular form of the invention has been illustrated and described, it will be apparent that various modifications can be made without departing from the spirit and scope of the invention. For example, the connector may be formed in various shapes or may be integrally formed with the shoe shank member, such as attached thereto with a living hinge and movable between an engaged and disengaged position. Further, the insertion stop may be present or absent and may include, where the heel member includes multiple height adjustment holes, a retractable pin that the user may retract to permit different sizes of adjustment.

Further, while multiple holes are shown as an option for the heel member, similar multiple holes may be formed in the shoe shank member, providing even more ability to adjust the shoe to a desired height. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A shoe comprising:

a shoe shank member extending between a heel end to a toe end of the shoe;

a heel member including an attachment end and a base end opposite the attachment end, the heel member removably attachable, at the attachment end thereof, to the shoe shank member, wherein:

the attachment end of the heel member is insertable into the shoe shank member in a first direction to create a first shoe configuration;

the attachment end of the heel member is insertable into the shoe shank member in a second direction to create a second shoe configuration;

the heel member is capable of supporting the shoe in at least one upright position in both of the first and second shoe configurations; and the base end of the heel member is disposed rearward of the attachment end of the heel member in both of the first and second shoe configurations.

2. The shoe of claim 1, wherein the first shoe configuration has a first heel height less than a second heel height of the second shoe configuration.

3. The shoe of claim 1, wherein the heel member further includes two or more attachment positions providing two or more heel heights in at least one of the first shoe configuration and the second shoe configuration.

4. The shoe of claim 1, further comprising first and second opposing shoulders disposed along sides of a portion of a bottom of the shoe shank member, the opposing shoulders operable to receive the attachment end of the heel member therein.

5. The shoe of claim 4, wherein the opposing shoulders include an upper surface mating with a lower surface of the attachment end of the heel member.

6. The shoe of claim 4, wherein the opposing shoulders are located centrally along a length of the shoe shank member.

7. The shoe of claim 1, further comprising an insertion stop disposed adjacent the attachment end of the heel member, the insertion stop providing a maximum insertion of the attachment end of the heel member into the shoe shank member.

8. The shoe of claim 1, further comprising:

a shoe shank member hole formed through the shoe shank member; and one or more heel member holes formed through the heel member, wherein:

the shoe shank member hole aligns with one of the one or more heel member holes when the attachment end of the heel member is inserted into the shoe shank member.

9. The shoe of claim 8, further comprising a connector, the connector fitting into the shoe shank member hole and one of the one or more heel member holes to maintain a connection between the shoe shank member and the heel member.

10. The shoe of claim 9, wherein the connector has an enlarged head with a shaft extending therefrom, the shaft operable to extend through the shoe shank member hole and one of the one or more heel member holes.

11. An adjustable height high heel shoe comprising:

a shoe shank member extending between a heel end to a toe end of the high heel shoe;

a heel member including an attachment end and a base end opposite the attachment end, the heel member removably attachable, at the attachment end thereof, to the shoe shank member, wherein:

the attachment end of the heel member is user insertable into the shoe shank member in a first direction to create a first shoe configuration;

the attachment end of the heel member is user insertable into the shoe shank member in a second direction to create a second shoe configuration;

the first shoe configuration creating a first heel height less than a second heel height in the second shoe configuration;

the heel member is capable of supporting the high heel shoe in at least one upright position in both of the first and second shoe configurations; and the base end of the heel member is disposed rearward of the attachment end of the heel member in both of the first and second shoe configurations.

12. The adjustable height high heel shoe of claim 11, further comprising first and second opposing shoulders disposed along sides of a portion of a bottom of the shoe shank member, the opposing shoulders operable to receive the attachment end of the heel member therein.

13. The adjustable height high heel shoe of claim 12, wherein the opposing shoulders include an upper surface mating with a lower surface of the attachment end of the heel member.

14. The adjustable height high heel shoe of claim 12, wherein the opposing shoulders are located centrally along a length of the shoe shank member.

15. The adjustable height high heel shoe of claim 11, further comprising an insertion stop disposed adjacent the attachment end of the heel member, the insertion stop providing a maximum insertion of the attachment end of the heel member into the shoe shank member.

16. The adjustable height high heel shoe of claim 11, further comprising:

a shoe shank member hole formed through the shoe shank member; and one or more heel member holes formed through the heel member, wherein:

the shoe shank member hole aligns with one of the one or more heel member holes when the attachment end of the heel member is fully inserted into the shoe shank member.

17. The adjustable height high heel shoe of claim 16, further comprising a connector, the connector fitting into the shoe shank member hole and one of the one or more heel member holes to maintain a connection between the shoe shank member and the heel member.

18. The adjustable height high heel shoe of claim 17, wherein the connector has an enlarged head with a shaft extending therefrom, the shaft operable to extend first through the shoe shank member hole and then through one of the one or more heel member holes.

19. A method of changing a height of a high heel shoe, comprising:

removably inserting an attachment end of a heel member into a bottom portion of a shoe shank member in a first direction, the shoe shank member extending between a heel end to a toe end of the high heel shoe, wherein the resulting high heel shoe has a first heel height, the heel member is capable of supporting the high heel shoe in at least a first upright position, and a base end of the heel member, opposite the attachment end of the heel member, is disposed rearward of the attachment end of the heel member; and removably inserting the attachment end of the heel member into the bottom portion of the shoe shank member in a second direction, wherein the resulting high heel shoe has a second heel height greater than the first heel height, the heel member is capable of supporting the high heel shoe in at least a second upright position, and the base end of the heel member is disposed rearward of the attachment end of the heel member.

20. The method of claim 19, further comprising inserting a connector through aligned holes of the heel member and the shoe shank member to secure the high heel shoe in one of a first shoe configuration, having the first heel height, and a second shoe configuration, having the second heel height.

* * * * *